US011624569B2

(12) United States Patent
Cavanaugh et al.

(10) Patent No.: US 11,624,569 B2
(45) Date of Patent: Apr. 11, 2023

(54) STRIKER FIRED PISTOL

(71) Applicant: O.F. MOSSBERG & SONS, INC., North Haven, CT (US)

(72) Inventors: Lee Cavanaugh, Winchester, CT (US); Peter Duperry, Cheshire, CT (US); Salvatore Pietrzyk, Wallingford, CT (US)

(73) Assignee: O.F. MOSSBERG & SONS, INC., North Haven, CT (US)

( * ) Notice: Subject to any disclaimer, the term of this patent is extended or adjusted under 35 U.S.C. 154(b) by 0 days.

(21) Appl. No.: 17/419,158

(22) PCT Filed: Dec. 27, 2019

(86) PCT No.: PCT/US2019/068724

§ 371 (c)(1),
(2) Date: Jun. 28, 2021

(87) PCT Pub. No.: WO2020/140024

PCT Pub. Date: Jul. 2, 2020

(65) Prior Publication Data

US 2022/0099393 A1 Mar. 31, 2022

Related U.S. Application Data

(60) Provisional application No. 62/785,475, filed on Dec. 27, 2018.

(51) Int. Cl.

| | |
|---|---|
| ***F41A 3/00*** | (2006.01) |
| ***F41A 3/66*** | (2006.01) |
| ***F41A 11/00*** | (2006.01) |
| ***F41C 3/00*** | (2006.01) |

(52) U.S. Cl.
CPC ..... *F41A 3/66* (2013.01); *F41A 11/00* (2013.01); *F41C 3/00* (2013.01)

(58) Field of Classification Search
CPC ..... F41A 3/66; F41A 3/68
See application file for complete search history.

(56) References Cited

U.S. PATENT DOCUMENTS

| | | | |
|---|---|---|---|
| 5,913,666 | A | 6/1999 | Perkins |
| 8,028,451 | B1 | 10/2011 | Pontillo, II |
| 8,028,454 | B1 | 10/2011 | Pontillo, II |
| 8,468,734 | B2 | 6/2013 | Meller et al. |
| 8,528,242 | B2 | 9/2013 | Green et al. |
| 2015/0184966 | A1 | 7/2015 | Beck |

(Continued)

FOREIGN PATENT DOCUMENTS

| | | | |
|---|---|---|---|
| WO | 2020140024 | A1 | 7/2020 |

OTHER PUBLICATIONS

International Search Report and Written Opinion for PCT/US2019/68724, dated May 5, 2020.

(Continued)

*Primary Examiner* — J. Woodrow Eldred
(74) *Attorney, Agent, or Firm* — Kulak Rock LLP

(57) ABSTRACT

A pistol having a frame and a slide assembly slideably coupled to the frame is disclosed. The slide assembly includes a plate including a housing and a button slideably coupled to the slide assembly near a rear of the pistol. The plate further includes a bearing surface for contacting the frame to limit the forward travel of the slide relative to the frame.

21 Claims, 6 Drawing Sheets

(56) References Cited

U.S. PATENT DOCUMENTS

| | | | | |
|---|---|---|---|---|
| 2017/0211901 | A1 | 7/2017 | Keller et al. | |
| 2021/0389078 | A1* | 12/2021 | Steindl | F41A 11/00 |

OTHER PUBLICATIONS

"International Preliminary Report on Patentability Received for PCT Application No. PCT/US2019/068724, Report dated Jun. 16, 2021, dated Jul. 8, 2021."

* cited by examiner

STRIKER FIRED PISTOL

This is the United States National Stage of Patent Cooperation Treaty Application No. PCT/US19/68724 filed Dec. 27, 2019, which claims priority to provisional 62/785,475, filed Dec. 27, 2018, the disclosures of which are incorporated herein by reference in their entireties.

BACKGROUND

The present disclosure relates to striker fired pistols. In particular, the present disclosure relates to a striker fired pistol having a removable cover plate.

Striker fired pistols are typically characterized in that they have a firing pin or striker coupled to a striker spring. The striker sprint(spring?) may be completely or partially compressed by the action of the slide in loading a round of ammunition into the chamber. The striker spring is released during the act of pulling the trigger. This is in contrast to hammer filed pistols that release a hammer spring which urges the hammer forward to strike the firing pin or transfer plate.

Striker fired pistols typically house the striker in a slide. The striker may be retained in the slide by a cover plate positioned at the rear of the slide. On conventional striker fired pistols, the cover plate remains in its position on the slide as the slide is removed from the frame. This configuration, in combination with the design of the fire control parts of these conventional pistols means that the striker must be released on an empty chamber prior to disassembly. Typically, a user would render the pistol safe by unloading it, dry firing the pistol, then removing the slide. To remove the slide, a retainer positioned in the frame forward of the trigger pivot pin us moved, such as by sliding it downward, away from the barrel, against the urging of a spring. The retainer, when up, interferes with one or more features of the slide or barrel assembly to prevent the slide from moving forward of its firing position.

Requiring the user to dry fire the pistol to disassemble it has resulted in accidental shootings and injuries. These can occur when the user forgets to cycle the pistol to remove the round from the chamber, cycles the action prior to removing the magazine, or simply neglects to unload the pistol.

Accordingly there is a need for an improved, striker fired pistol that can be disassembled without dry firing the pistol.

DETAILED DESCRIPTION OF THE DRAWINGS

Figure 1:
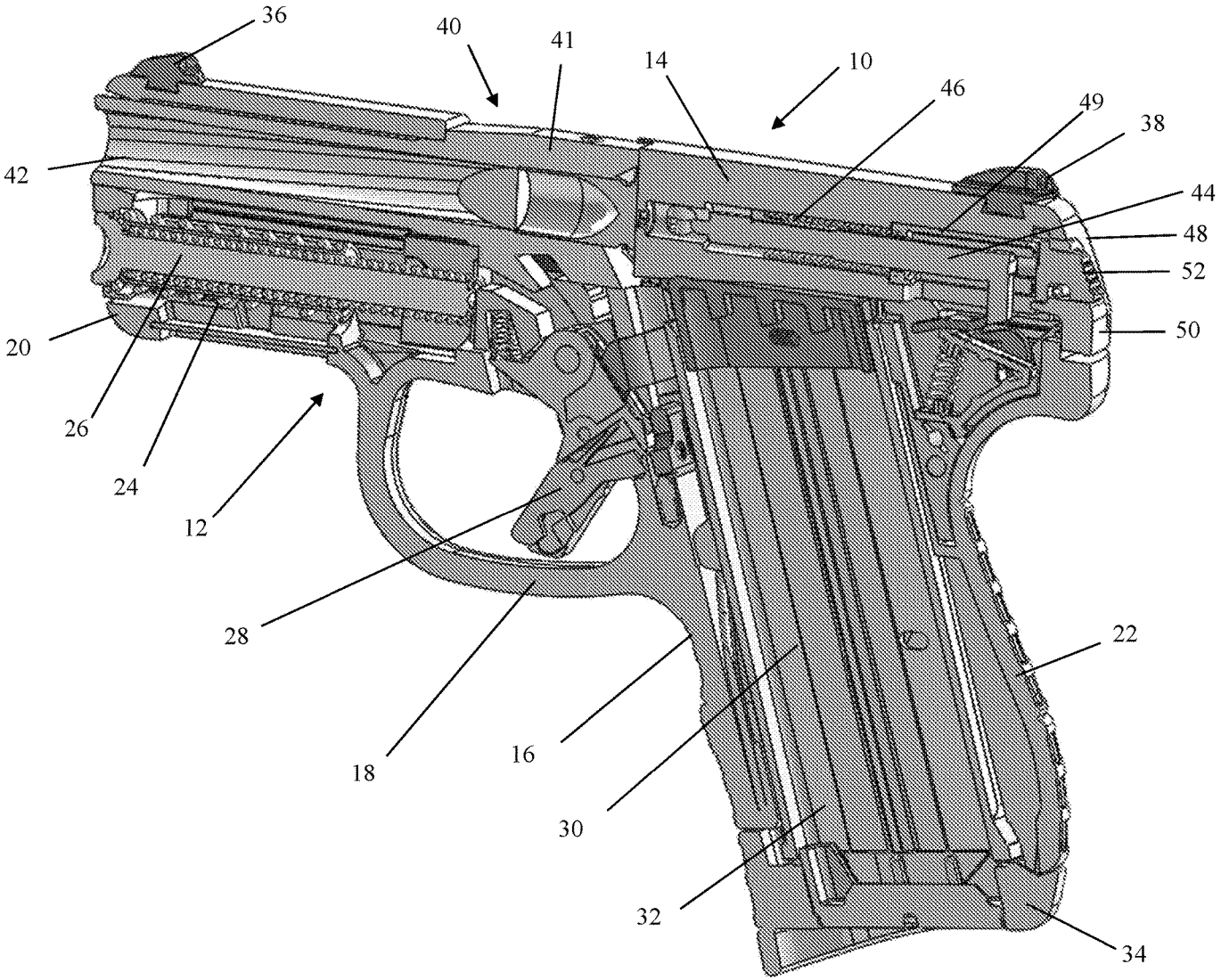
FIG. 1 is a cutaway view of a pistol according to the present invention.
Figure 2:
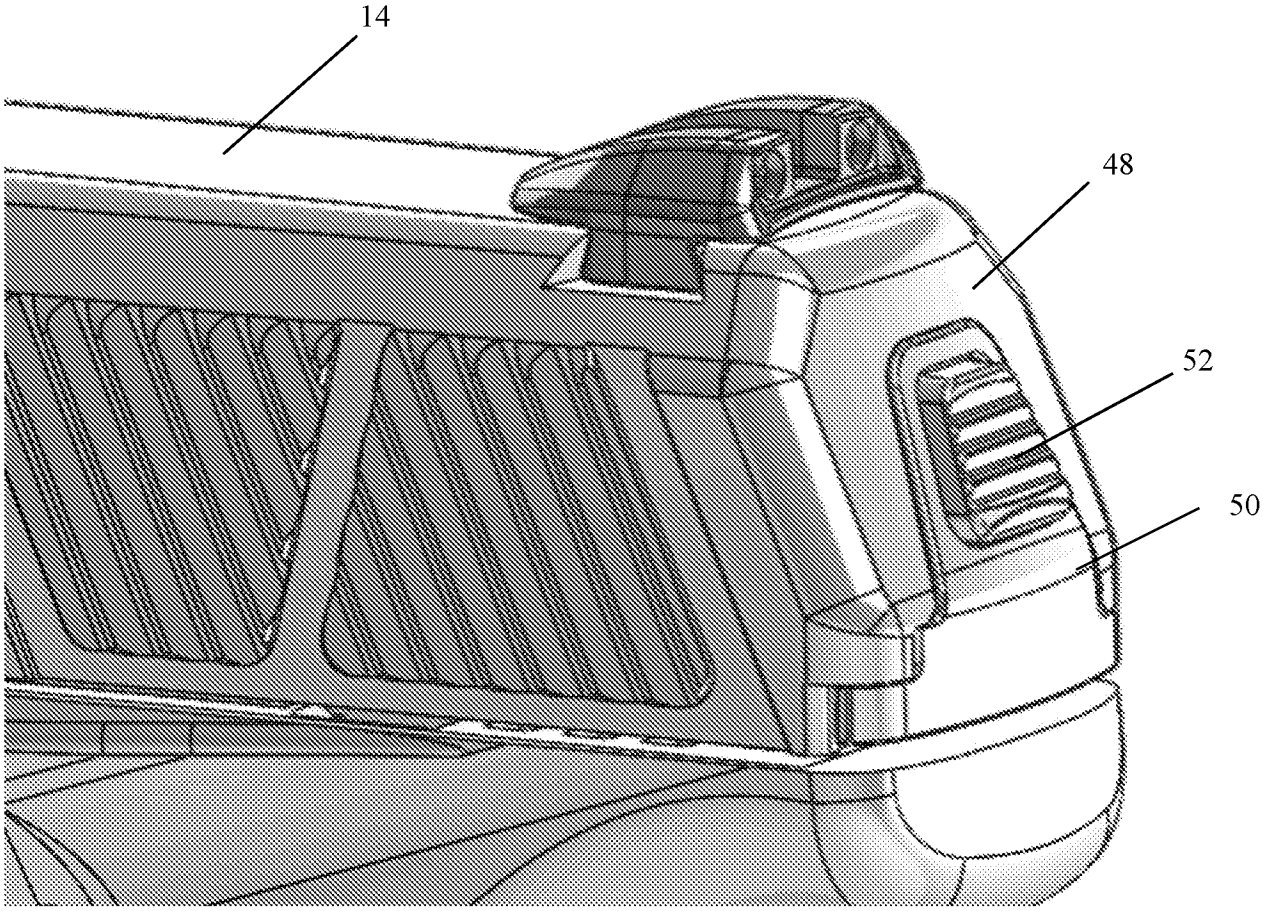
FIG. 2 is a rear, side, elevation view of the pistol of FIG. 1.
Figure 3:
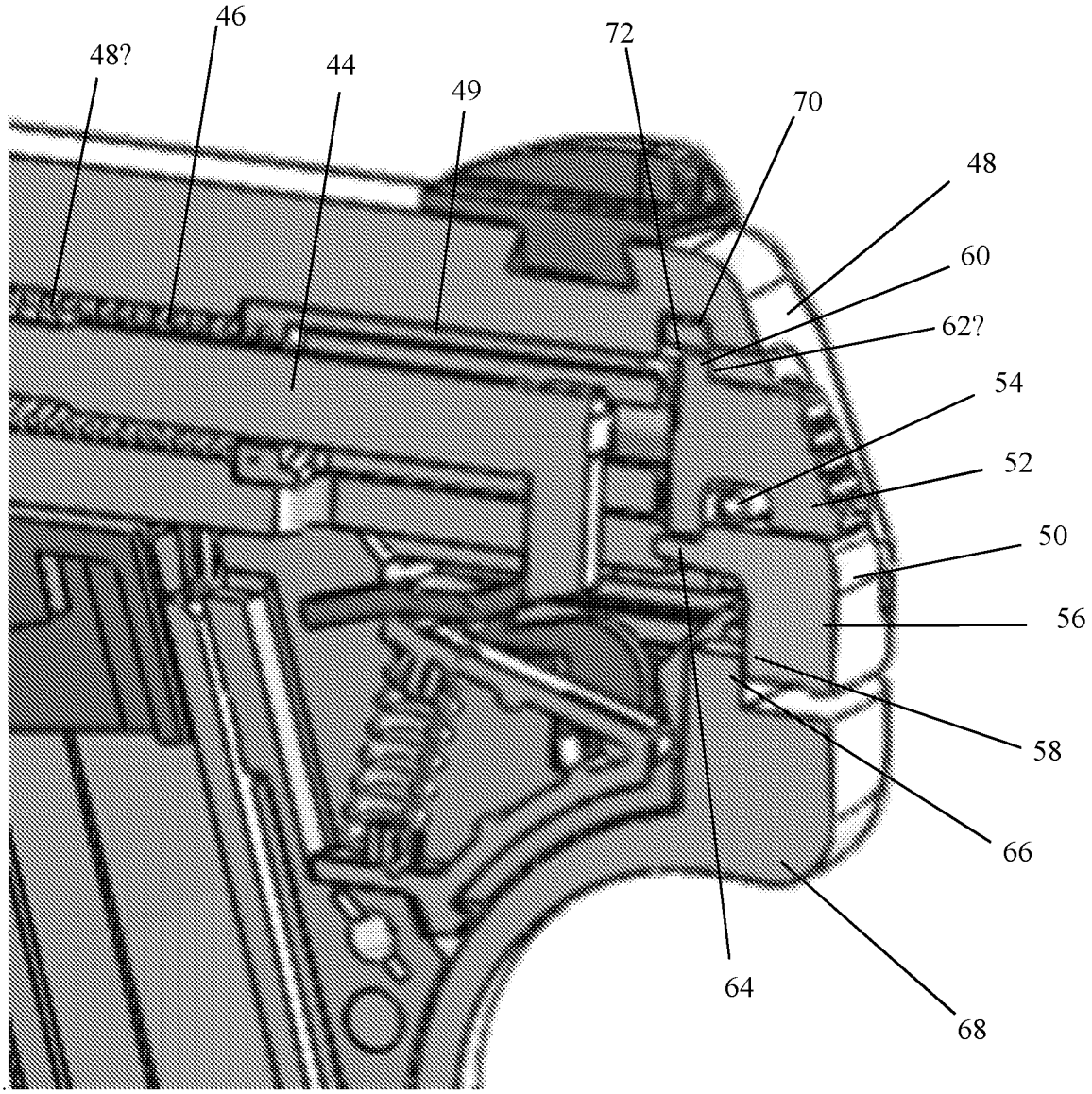
FIG. 3 is a partial cutaway view of the pistol of FIG. 1.
Figure 4:
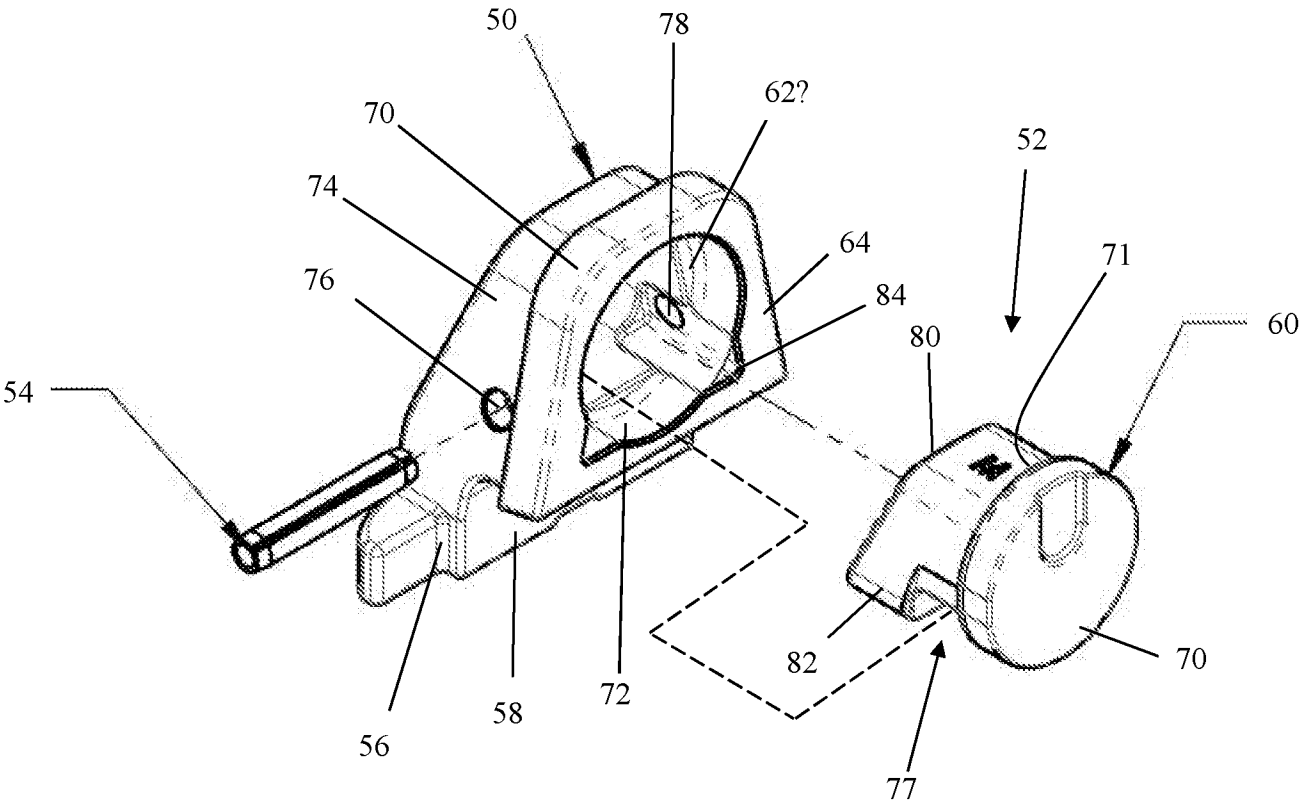
FIG. 4 is an exploded, elevation view of the slide plate of the pistol of FIG. 1.
Figure 5:
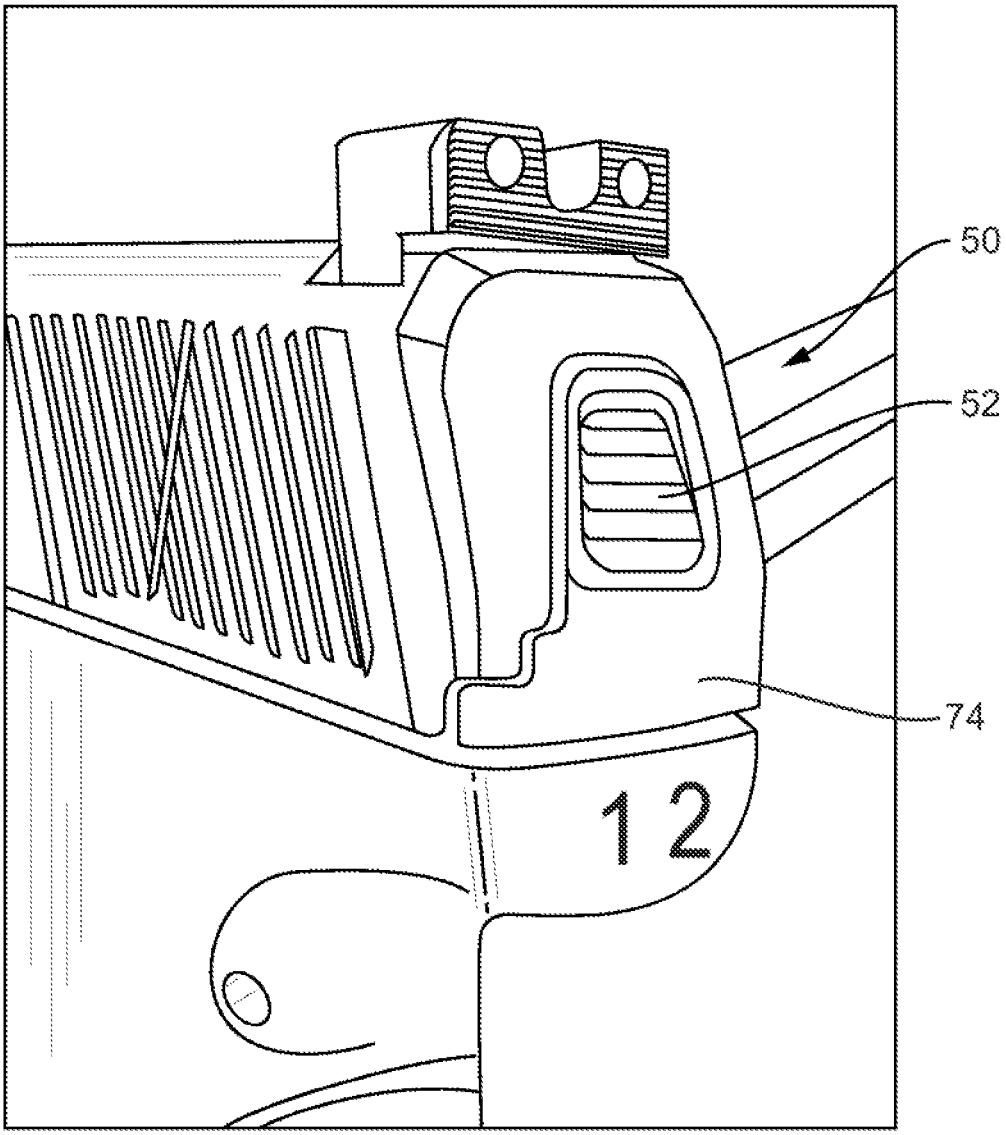
FIG. 5 is a color photograph of a pistol according to the present invention.
Figure 6:
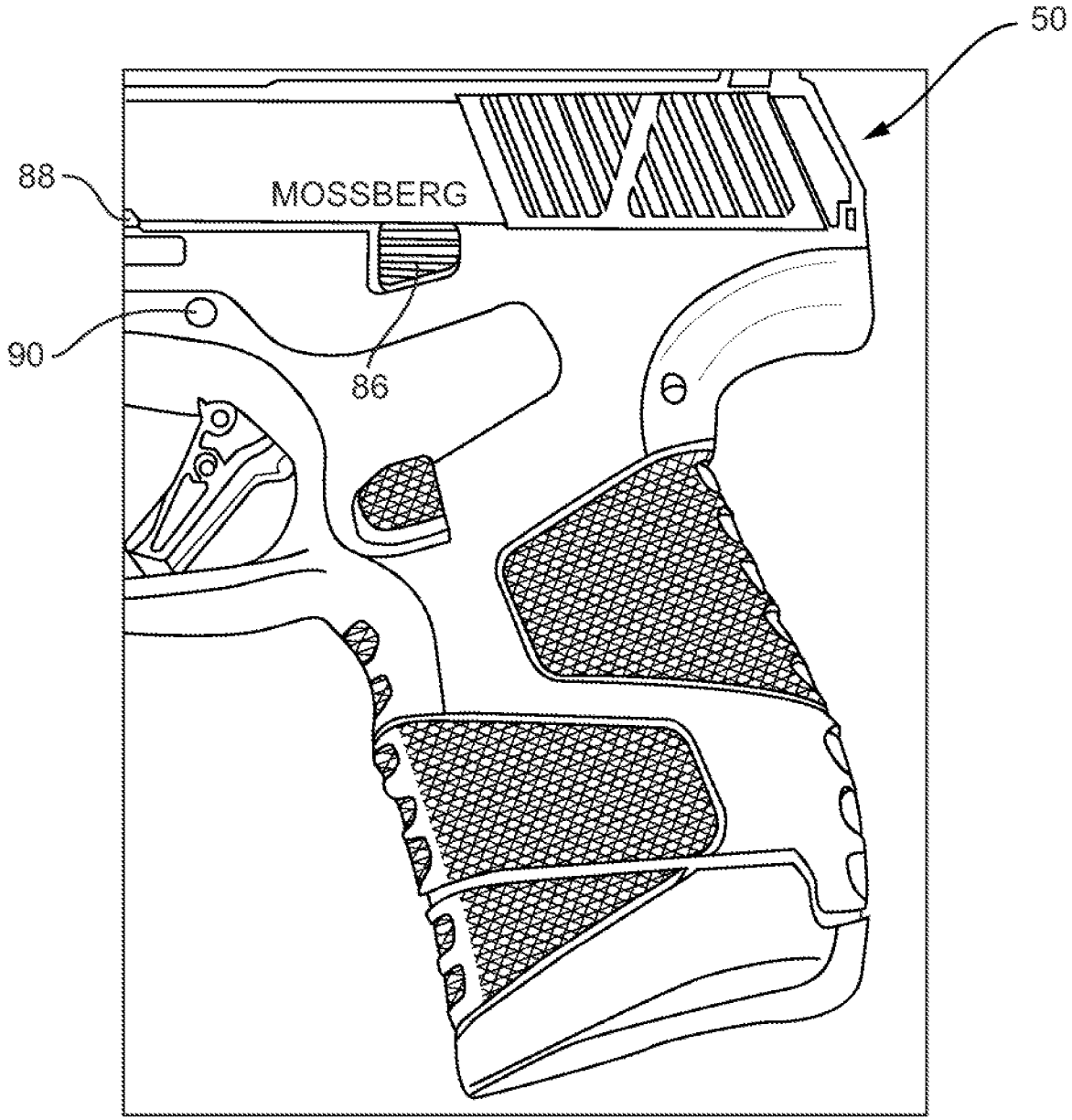
FIG. 6 is another color photograph of the pistol of FIG. 5.

Referring to the drawings, a striker fired pistol 10 has a frame 12 and a slide 14. Frame 12 includes grip frame 16, trigger guard 18, and dust cover 20. Grip frame 16 may be provided with a back strap 22 that is contoured to fit a user's grip. In some embodiments, the back strap 22 may be removable and replaceable so that one of a variety of back strap configurations can be selected based on a particular user's hand size and grip.

Dust cover 20 houses a recoil spring 24 that partially surrounds a guide rod 26. Recoil spring 24 may be a single coil spring or a dual spring as shown. Trigger 28 extends through an opening in frame 12 and into trigger guard 18.

Grip frame 16 defines a cavity configured to receive a magazine 30. Magazine 30 includes a magazine body 32 and a base plate 34. Slide 14 includes front sight 36 and a rear sight 38. Each of front sight 36 and rear sight 38 may be a separate component fitted to slide by a dovetail or other means, or sights 36 and 38 may be machined as part of slide 14. Slide 14 includes an ejection port 40 which exposes chamber 41 of barrel assembly 42 when the slide is in battery. Slide 14 also houses striker 44, striker spring 46, and striker sleeve 49. When assembled, and the pistol 10 is ready to fire, striker 44 may be retained towards the rear by a sear or other component such that striker spring 46 is partially compressed between the rear face of a protrusion on striker 44 and a front face of striker sleeve 49.

A cover plate 50 is provided proximate to the rear of slide 14. In some embodiments, slide 14 may include portion 48 which partially surrounds and receives portions of striker plate 50. Striker plate 50 includes an opening through which button 52 extends. Pin 54, shown as a roll pin, restricts the forward motion of button 52 to retain button 52 within striker plate 50. Striker plate 50 further includes a lower portion 56 which has a front face 58. Button 52 includes an extension 60 having a rear face 71 that stops on face 62 of cover plate 50. Protrusion 64 extends outwardly and is at least partially received into a slot in slide 14 when cover plate 50 in inserted. In use, striker spring 46 biases striker sleeve 49 rearward against button 52. With button 52 towards the rear, striker sleeve 49 is partially received into a cavity in cover plate 50 that is defined, at least in part, by interior face 72 of locking portion 70 of cover plate 50. This results in a configuration in which striker sleeve 49 partially interferes with interior face 72 and prevents striker plate 50 from sliding downward.

When striker plate 50 is assembled with slide 14 and coupled to frame 12, front face 58 contacts a vertical face 66 of tang portion 68. The interference of front face 58 with vertical face 66 prevents slide 14 from moving forward of the position shown when slide 14 is assembled onto frame 12 with striker plate 50 in place. To disassemble pistol 10, a user may pull slide 14 to the rear and lock it in that position by pushing slide stop 86 up to interface with slide stop notch 88 in slide 14. With slide 14 locked to the rear, the user may depress button 52 to move striker sleeve 49 forward and compressing striker spring 46. At a point where striker sleeve 49 no longer interferes with interior face 72, striker plate 50 may be removed from slide 14 by sliding striker plate 50 downward to remove protrusion 64 from the corresponding slot in slide 14. Once striker plate 50 is removed, slide 14 may be moved forward on frame 12, past the firing position, and removed from frame 12. This eliminates the need for a takedown feature forward of the trigger pivot pin 90 common on existing striker fired pistols.

Cover plate 50 includes button 52 that is received into cover plate housing 74. Cover plate housing 74 includes lower portion 56 which has front face 58. An opening is defined by inner surface 72 and receives button 52. When assembled, button 52 is retained by Pin 54. Pin 54 is inserted through aperture 76, through area 77 located along the underside of button 52, and through aperture 78 to capture and retain button 52 in cover plate housing 74.

As seen in the figures, button 52 has a contact surface 80 of a generally trapezoidal shape. Contact surface 80 may include ridges, stippling, or other texturing to provide a user purchase or to quickly identify button 52. The trapezoidal shape provides a base 82 which interfaces with channels 84 in cover plate housing 74. This prevents rotation of button 52 about a longitudinal axis.

What is claimed is:

1. A pistol comprising:

a frame;

a slide assembly, the slide assembly comprising:

a slide, the slide slidably coupled to an upper portion of the frame and reciprocates horizontally with respect to the frame from a forward battery position to a backward open position;

a cover plate removably engaged with a rear section of the slide, the cover plate including a protrusion extending outwardly and being configured to engage with the rear section of the slide; and wherein the cover plate includes a housing, the housing extending from the protrusion to a lower portion of the cover plate; and a button, wherein the cover plate defines an opening through which the button extends; wherein the button is movably retained to the cover plate by a roll pin, thereby permitting the button to travel along a path from a first position to a second position; and wherein the button's first position defines a locking cavity, the locking cavity being configured to removably retain a striker sleeve.

2. A method for preventing the forward movement of a slide assembly while a slide cover plate is slidably affixed, the method comprising:

affixing the slide cover plate slidably coupled to the slide assembly near a rear of a pistol while the slide assembly is in a backward open position;

moving the slide assembly from the backward open position to a forward battery position;

receiving a first force exerted by a lower portion front face of the slide cover plate in contact with a vertical face of a tang portion of said pistol;

receiving a second force exerted by the slide assembly in contact with a protrusion first interior face of the slide cover plate; and retaining a striker sleeve within a slide cover plate locking cavity when the slide cover plate is in an engaged position, thereby restricting the vertical movement of the slide cover plate.

3. The method of claim 2, wherein the first force exerted by the lower portion front face of the slide cover plate extends forwardly of a front portion of said pistol.

4. The method of claim 2, wherein the vertical face of the tang portion of said pistol exerts a third force on the lower partition front face of the slide cover plate extending rearwardly of said pistol.

5. The method of claim 2, wherein the second force exerted by the slide assembly in contact with the protrusion first interior face is exerted forwardly of said pistol.

6. The method of claim 2, wherein a fourth force is exerted by the slide assembly in contact with a protrusion second interior face of the slide cover plate extending rearwardly of said pistol.

7. The method of claim 2, wherein moving the slide assembly from the rearward open position to the forward battery position comprises moving the slide assembly horizontally with respect to a pistol frame.

8. The method of claim 2, wherein retaining the striker sleeve within the slide cover plate locking cavity when the slide cover plate is in the engaged position further comprises utilizing a striker assembly to bias a slide cover plate button in a direction rearward of said pistol.

9. The method of claim 8, the method further comprises removably retaining the slide cover plate button within the slide cover plate with a roll pin.

10. The method of claim 9, further comprises moving the slide cover plate from an engaged position to a removed position by urging the slide cover plate button in a direction forwardly of said pistol while the slide assembly is in the backward open position, thereby removing the striker sleeve from the locking cavity and allowing the slide cover plate to move vertically downward and away from the slide assembly.

11. The pistol of claim 1, the opening including one end at a protrusion front face and extending to a housing rear face.

12. The pistol of claim 11, wherein the opening includes an at least one channel, the at least one channel extending from the protrusion front face to the housing rear face.

13. The pistol of claim 1, the housing including an at least one contact surface, wherein the contact surface extends from a housing interior surface and into the opening.

14. The pistol of claim 1, wherein the button comprises:

a body, the button body including one end extending to a contact surface and the other end extending to a button extension;

a base located at a lower portion of the button body, the base including a trapezoidal shape and being configured to slidably interface with the at least one channel; and a notch, the notch extending from the button base to the button extension and being configured for engaging the roll pin.

15. The pistol of claim 14, wherein the button extension protrudes from the button body and being configured for engagement with the striker plate housing opening.

16. The pistol of claim 15, the button extension comprising:

a locking surface, the locking surface extending towards a front portion of the button and being configured for removably engaging the striker sleeve; and a rear face, the rear face extending towards a rear portion of the button and being configured for engaging the housing least one contact surface.

17. The pistol of claim 14, the roll pin extending from a housing first aperture through the button notch and ending in a housing second aperture.

18. The pistol of claim 14, wherein when the button is in the first position, the roll pin contacts a first surface of the button extension, and wherein the button rear face is in contact with the housing at least one contact surface, thereby limiting the button's travel towards the rear portion of the cover plate.

19. The pistol of claim 14, wherein when the button is in the second position, the roll pin contacts a first surface of the button base, thereby limiting the button's travel towards the front portion of the cover plate.

20. The pistol of claim 16, the locking cavity being further defined by the button locking surface and the housing interior surface, thereby preventing vertical movement of the cover plate when engaged with a striker sleeve, wherein the button is in the first position.

21. The pistol of claim 1, wherein the button's second position removes the locking cavity, thereby permitting the cover plate to move vertically downward, when the pistol is in the reward configuration.

* * * * *